US007168280B2

(12) United States Patent
Mark et al.

(10) Patent No.: US 7,168,280 B2
(45) Date of Patent: Jan. 30, 2007

(54) ROLL-CHANGING TOOL

(75) Inventors: Wolfgang Mark, Meerbusch (DE); Jörg Prey, Tönisvorst (DE); Bernd Diepers, Issum (DE)

(73) Assignee: Eduard Kusters Maschinenfabrik GmgH & Co. KG, Krefeld (DE)

( * ) Notice: Subject to any disclaimer, the term of this patent is extended or adjusted under 35 U.S.C. 154(b) by 0 days.

(21) Appl. No.: 11/315,833

(22) Filed: Dec. 21, 2005

(65) Prior Publication Data

US 2006/0144115 A1 Jul. 6, 2006

(30) Foreign Application Priority Data

Dec. 30, 2004 (DE) ..... 10 2004 063547

(51) Int. Cl.
*B21B 31/08* (2006.01)

(52) U.S. Cl. ..... 72/239; 294/67.2; 294/67.33; 414/911

(58) Field of Classification Search ..... 72/238, 72/239; 294/67.3, 82.12, 82.15, 82.21, 67.2, 294/67.21, 67.22, 104, 67.33; 414/911
See application file for complete search history.

(56) References Cited

U.S. PATENT DOCUMENTS 808,719 A * 1/1906 Bray ..... 294/67.2
2,165,921 A * 7/1939 Duda ..... 294/67.2
2,495,658 A * 1/1950 Moseley ..... 294/67.21
2,514,307 A * 7/1950 Boyd ..... 294/67.21
3,425,256 A * 2/1969 McGoogan et al. ..... 72/239
3,729,102 A * 4/1973 Shumaker ..... 414/746.8
3,870,356 A * 3/1975 Meads ..... 294/81.5
3,905,485 A * 9/1975 Shumaker ..... 414/663
3,994,488 A * 11/1976 Takenaka et al. ..... 271/98
4,090,388 A * 5/1978 Pim ..... 72/239
4,251,180 A * 2/1981 Hansen ..... 414/560
5,078,000 A * 1/1992 Matsuo et al. ..... 72/238

FOREIGN PATENT DOCUMENTS

DE 19633668 C1 * 11/1997
DE 19633669 C1 11/1997
DE 19856517 A1 6/2000

* cited by examiner

*Primary Examiner*—Dmitry Suhol
(74) *Attorney, Agent, or Firm*—Townsend and Townsend and Crew LLP

(57) ABSTRACT

Roll-changing tool having a dismantling device which can be supported on a rolling machine by a hook and which, on a carrier, has a lifting device mounting and a roll holder for a roll journal of a roll, the carrier having a trolley which can be moved in its longitudinal direction into the region of its head, carries the roll holder, whose holding opening faces the head and is located underneath the carrier, and the hook, which opens at the bottom, being fixed to the head of the carrier with a shaft extension ending in a projecting manner transversely with respect to the running direction of the trolley.

7 Claims, 2 Drawing Sheets

ROLL-CHANGING TOOL

The invention relates to a roll-changing tool having a dismantling device which can be supported on a rolling machine using a hook.

DE 196 33 668 C1 discloses a roll-changing tool, which removes the roll to be changed in each case from the roll stack on a guide track. For this purpose, the roll has to roll on the guide track into a roll holder. Direct control of the movement of the roll on the guide track is not possible in this case, since the movement is caused by the action of the force of gravity. Furthermore, the guide track necessitates a long lever in order that the roll is moved out of the roll plane of the roll stack. Only in conjunction with a counterweight on the roll holder is it possible to ensure that, in all cases, the centre of gravity of the roll-changing tool is located underneath the lifting device mounting. As a result, the lever always has an alignment substantially in the horizontal direction when the roll-changing tool is suspended on the roll-changing crane. Such a roll-changing tool has the disadvantage that a large lever arm is required, which is not only loaded with a counterweight but also experiences an additional loading as a result of a rolling movement of the roll.

DE 196 33 669 C1 discloses a roll-changing tool having two mutually opposite roll holders and a holding arm. The holding arm in this case projects laterally in relation to a plane which is formed by the central axes of the roll holders. The roll-changing tool has a suspension point, on which a crane hook can act.

DE 198 56 517 A1 discloses a device for roll changing in a calender, which has a transporting apparatus for transporting the rolls in and out. A changing device which can be carried along by the transporting apparatus has a holding device in each case for a first and a second roll. A transporting apparatus in the form of a crane has a hook, on which a changing device hangs by a pin.

The object of the invention is, therefore, to provide a roll-changing tool which permits a simple and rapid roll change.

This object is achieved by the features of Claim 1.

This provides a roll-changing tool which removes the roll to be changed from the roll stack in a simple and space-saving manner by means of trolleys. In this case, the roll-changing tool acts from above on the roll to be changed. The roll is therefore held suspended. A further advantage resides in the fact that, as a result, the lateral access to the rolling machine is also improved considerably. The control of the movement of the roll is additionally direct. Furthermore, the roll-changing tool permits a targeted, rapid roll change, since the roll-changing tool is steered over the shaft extension when it is suspended on the rolling machine. Moreover, the dismantling device is compact.

Further advantages and embodiments of the invention can be gathered from the following description and the dependent claims.

The invention will be explained in more detail below by using the exemplary embodiment illustrated in the appended figures.

Figure 1:
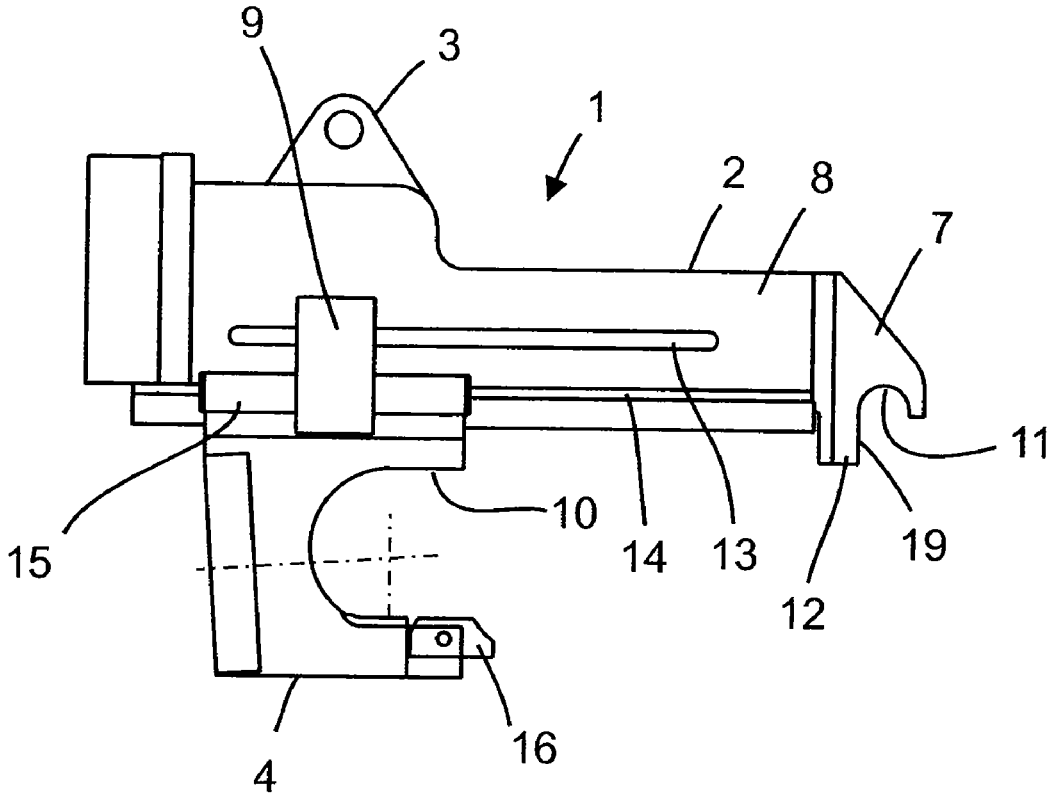
FIG. 1 shows, schematically, a side view of a roll-changing tool.
Figure 3:
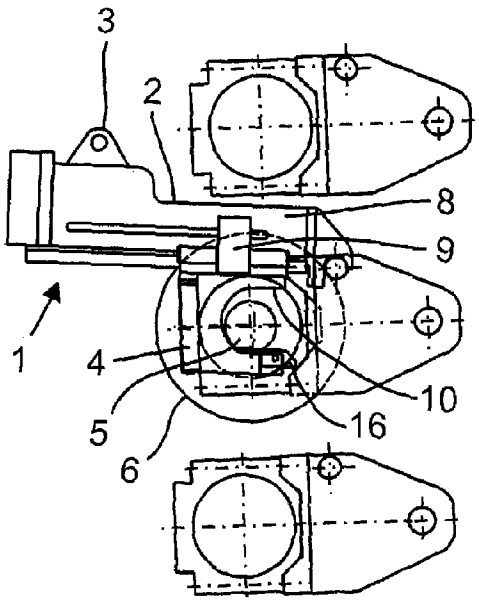
FIG. 3 shows, schematically, a side view of the roll-changing tool with a trolley in a holding position during the dismantling of a roll.
Figure 2:
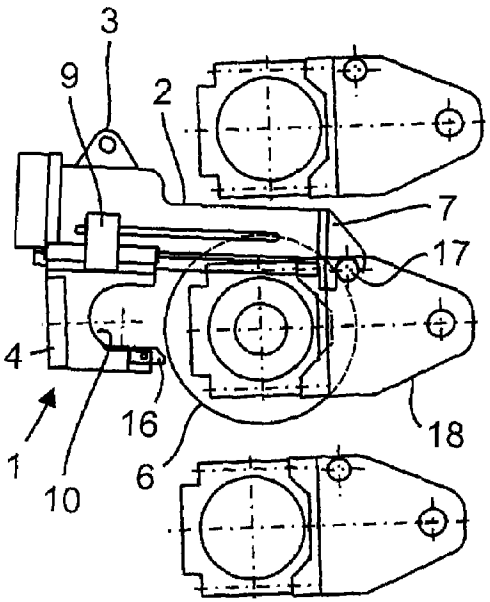
FIG. 2 shows, schematically, a side view of the roll-changing tool suspended on the rolling machine during the dismantling of a roll.

FIG. 1 shows a roll-changing tool having a dismantling device 1 which has a carrier 2, on which a lifting device mounting 3 for the action of a crane hook, not illustrated, and a roll holder 4 for holding a roll journal 5 of a roll 6 (cf. FIG. 4) are arranged. The dismantling device 1 also has a hook 7, via which the dismantling device 1 can be supported on a rolling machine, in particular a calender, as shown by FIGS. 2 and 3.

The carrier 2 has a trolley 9 which can be moved in its longitudinal direction into the region of its head 8. The trolley 9 carries the roll holder 4, whose holding opening 10 faces the head 8 and is located underneath the carrier 2.

The hook 7 is a hook 7 that opens at the bottom and has a hook opening 11. The hook 7 is fixed to the head 8 of the carrier 2 with a shaft extension 12 ending in a projecting manner transversely with respect to the running direction of the trolley 9.

The trolley 9 is guided in a rail 13 on the carrier 2, the rail 13 determining the direction of travel which, here, is aligned parallel to the longitudinal axis of the carrier 2. The trolley 9 can be moved by means of actuating devices, not illustrated.

The roll holder 4 is preferably attached firmly to the trolley 9, for which purpose the roll holder 4 has a carriage 15 on the top side, which can be moved and supported on a guide track 14 arranged underneath the rail 13 on the carrier 2. The roll holder 4 also has a securing pawl 16, which can be folded from a horizontal position illustrated in FIG. 1 into a vertical position illustrated in FIG. 4, in order to lock a roll journal 5 held in the holding opening 10. The holding opening 10 can be set parallel to or at an angle to the longitudinal axis of the carrier 2.

The shaft extension 12 can form a stop for the roll holder 4. Towards the hook opening 11, the shaft extension 12 has a guide surface 19, which projects with respect to the latter and is aligned with the latter in order to form an insertion track into the hook opening 11.

The roll-changing tool in each case comprises, for the two roll journals, one of the above-described dismantling devices 1, which are preferably devices which can be moved separately.

Figure 4:
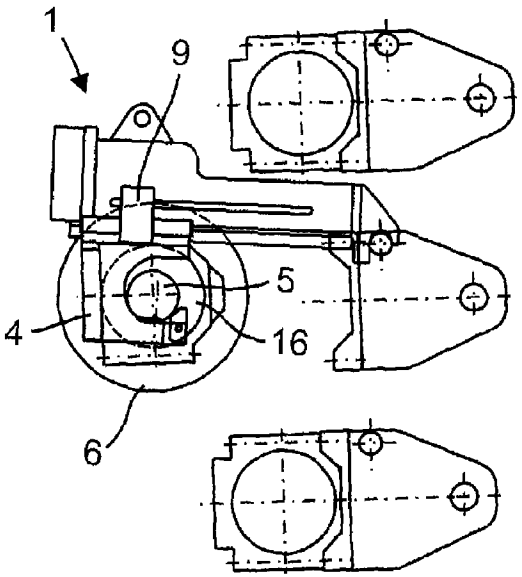
FIG. 4 shows, schematically, a side view of the roll-changing tool with a trolley in a roll-changing position.

FIGS. 2 to 4 illustrate how a roll change progresses. The dismantling of a roll 6 is illustrated. The roll-changing tool, moved to a roll stack and hooked in and in each case having a dismantling device 1 according to FIG. 1 for each roll journal 5, holds the two roll journals 5 of the roll 6 in a roll holder 4 in each case. In order to change the roll 6, the carrier 2 is hooked into by means of the hook 7 to a hook-in device 17 arranged on the calendar. The hook-in device 17 can be formed by a bolt, which can be arranged on a roll mounting 18 provided on a calender stand. The dismantling device 1 hooked in is illustrated in FIG. 2. In order to change the roll 6, the trolley 9 is then moved towards the head 8 of the carrier 2 and, as a result, moves the roll holder 4 in such a way that the roll end 5 passes into the holding opening 10, as illustrated in FIG. 3. The securing pawl 16 is then folded into the vertical position and the trolley 9 is moved back away from the head 8 of the carrier 2 by moving the trolley 9, as illustrated in FIG. 4.

The dismantling device 1 can then be raised by a roll-changing crane, which acts on the lifting device 3.

According to further exemplary embodiments, not illustrated, a displacement device in the transverse direction can also be provided for the purpose of positioning the rolls, such as a cross-slide, which moves the trolley not only along the rail but also transversely with respect thereto. Alternatively, for example, the hook can also be designed to be displaced transversely with respect to the running direction of the trolley.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

The invention claimed is:

1. A roll-changing tool comprising:

a beam-like carrier having a trolley beam track along a longitudinal extension ending at head portion which is provided with a hook for engagement with a rolling machine;

a trolley attached to the carrier by engaging the trolley beam track for moving along the longitudinal extension and carrying a roll holder for a roll journal of a roll;

wherein the roll holder comprises a holding opening which faces the head portion of the carrier and is located underneath the carrier;

and wherein the hook of the carrier opens at the bottom and comprises a shaft extension projecting transversely with respect to the running direction of the trolley defining a guide between the hook and the suspendedly held trolley to steer the carrier into an engagement with the rolling machine; and a lifting device fixed to the top side of the carrier.

2. The Roll-changing tool according to claim 1, wherein the trolley can be moved by means of an actuating device.

3. The Roll-changing tool according to claim 1, wherein the roll holder has a securing pawl.

4. The Roll-changing tool according to claim 1, wherein the shaft extension forms a stop for the roll holder.

5. The Roll-changing tool according to claim 1, wherein the hook is fixed such that it can be displaced transversely with respect to the running direction of the trolley.

6. The Roll-changing tool according to claim 1, wherein the roll holder further comprises a carriage and the carriage is formed as a cross-slide.

7. A roll-changing tool comprising a roll-changing tool according to claim 1 for the two roll journals of a roll.

* * * * *